US006182451B1

(12) United States Patent
Hadder

(10) Patent No.: US 6,182,451 B1
(45) Date of Patent: Feb. 6, 2001

(54) GAS TURBINE COMBUSTOR WAVING CERAMIC COMBUSTOR CANS AND AN ANNULAR METALLIC COMBUSTOR

(75) Inventor: James L. Hadder, Scottsdale, AZ (US)

(73) Assignee: AlliedSignal Inc., Morris Township, NJ (US)

( * ) Notice: Under 35 U.S.C. 154(b), the term of this patent shall be extended for 0 days.

(21) Appl. No.: 08/306,090

(22) Filed: Sep. 14, 1994

(51) Int. Cl.[7] ..... F23R 3/42
(52) U.S. Cl. ..... 60/732; 60/747; 60/753
(58) Field of Search ..... 60/753, 732, 39.32, 60/747, 39.37

(56) References Cited

U.S. PATENT DOCUMENTS

| | | | | |
|---|---|---|---|---|
| 2,446,013 | | 7/1948 | Kuyper . | |
| 2,447,482 | | 8/1948 | Arnold . | |
| 2,676,460 | * | 4/1954 | Brown | 60/747 |
| 2,885,858 | * | 5/1959 | Lloys | 60/747 |
| 3,594,109 | * | 7/1971 | Penny | 60/753 |
| 3,938,326 | | 2/1976 | DeCorso et al. . | |
| 3,990,231 | | 11/1976 | Irwin . | |
| 4,907,411 | * | 3/1990 | Krueger | 60/753 |

FOREIGN PATENT DOCUMENTS

| | | | | |
|---|---|---|---|---|
| 588572 | * | 5/1947 | (GB) | 60/732 |

OTHER PUBLICATIONS

Enabling Propulsion Materials Program, Quarterly Technical Progress Report–Contract NAS3–26385 dated Apr. 25, 1994.

Hazard, H.R., No Emission from Experimental Compact Combustors, ASME 72–GT–105, Mar. 1972. pp.1–8.*

* cited by examiner

*Primary Examiner*—Timothy S. Thorpe
(74) *Attorney, Agent, or Firm*—James W. McFarland

(57) ABSTRACT

A hybrid combustor for a gas turbine engine includes a plurality of circularly arrayed ceramic can combustors whose outlets communicate with the inlet of an annular, metal combustor. The combustion process is continuous through the plurality of can combustors and into the single annular combustor. Preferably only fuel-rich combustion occurs within each of the can combustors, and fuel-lean combustion continues within the single annular combustor.

11 Claims, 2 Drawing Sheets

GAS TURBINE COMBUSTOR WAVING CERAMIC COMBUSTOR CANS AND AN ANNULAR METALLIC COMBUSTOR

TECHNICAL FIELD

This invention pertains to combustors for gas turbine engines, and pertains more particularly to an improved hybrid combustor incorporating the ceramic can combustors and a metallic annular combustor.

1. Background of the Invention

Gas turbine engine efficiency increases with increased temperature. To this end, it has been proposed to utilize ceramic components within gas turbine engines, particularly at the highest temperature locations therein, to increase gas turbine engine maximum temperatures. Utilization of ceramics, such as ceramic matrix composites, in the combustor of the gas turbine engine is therefore highly desirable.

However, ceramic material such as ceramic matrix composites are sensitive to the temperature difference through the thickness of the material. The temperature difference between the hot interior and the cooler exterior generate thermal stresses resulting in cracking of the ceramic matrix. This limits the allowable wall thickness of the design making it difficult to produce a conventional annular ceramic combustor configuration of a reasonably large diameter which needs larger wall thickness to withstand the buckling pressures associated with the larger diameters. Ceramic designs are thus limited by small diameter, low pressure drop, low heat loading, or a reduced combination of such factors, which ultimately limit the combustor performance.

2. Summary of the Invention

Accordingly, it is an important object of the present invention to provide an improved combustor for a gas turbine engine which utilizes ceramic materials in a geometric configuration which avoids the problems normally associated with such use of ceramics. More particularly, it is an important object of the present invention to provide a hybrid combustor having a plurality of can-type ceramic combustors disposed in a circular array, along with a conventional metallic annular combustor construction. summary, the present invention contemplates a plurality of ceramic can combustors each having a cylindrical ceramic wall, wherein primary, fuel-rich combustion occurs, along with a single annular, metallic combustor which receives the exhaust of the fuel-rich burn from all of the can combustors, along with pressurized air flow from the combustor inlet. Fuel-lean combustion continues to occur in the annular metallic combustor as a continuation of the fuel-rich combustion process in each of the can combustors. In this manner the ceramic cylindrical walls of the can combustors can be made of relatively small diameter to minimize thermal stresses and buckling forces thereon.

These and other objects and advantages of the present invention are specifically set forth in or will become apparent from the following detailed description of a preferred embodiment of the invention when read in conjunction with the accompanying drawings.

DETAILED DESCRIPTION OF THE PREFERRED EMBODIMENT

Figure 1:
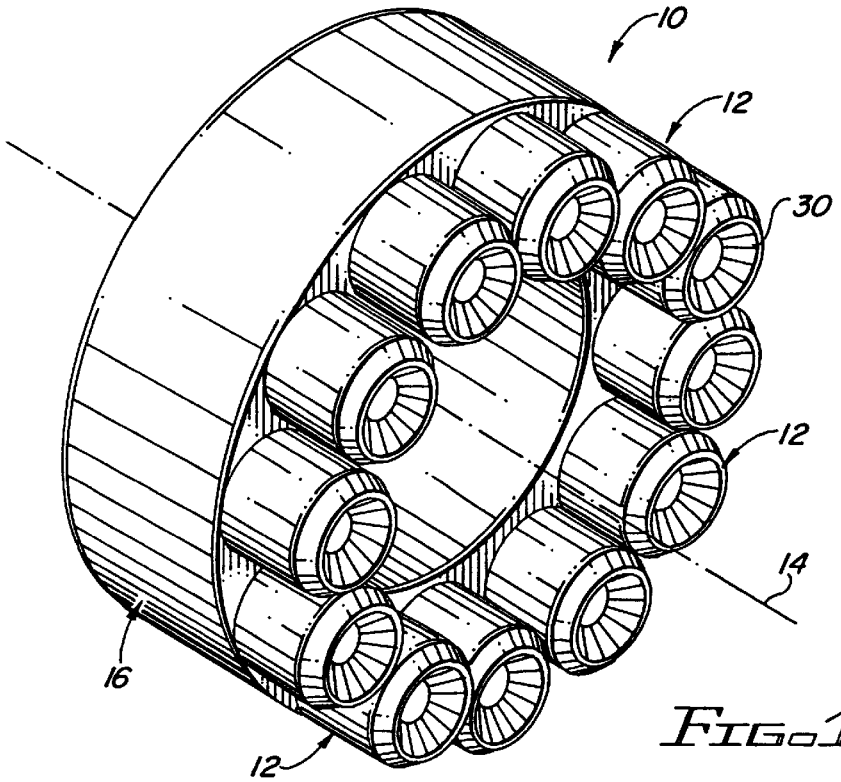
FIG. 1 is a schematic, perspective representation of a hybrid combustion constructed in accordance with the principles of the present invention.
Figure 2:
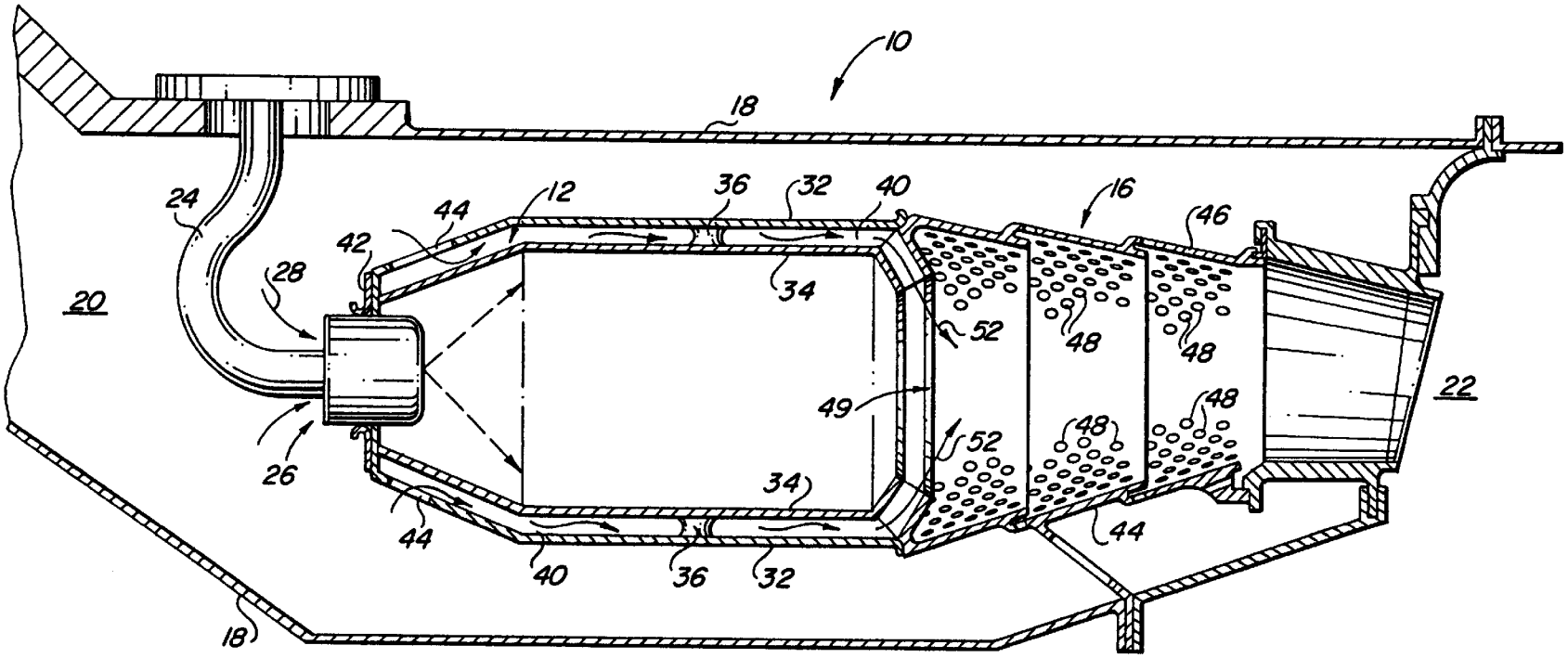
FIG. 2 is a cross-sectional plan view of the hybrid combustor of the present invention.

Referring now more particularly to the drawings, a gas turbine engine combustor 10 generally includes a plurality of can combustors 12 disposed in a circular array about the central axis 14 of an associated annular combustor 16. As best depicted in FIG. 2, the gas turbine engine combustor 10 includes an annular outer casing 18 having a pressurized air inlet 20, an exhaust 22, and a fuel supply duct 24 leading to a fuel nozzle 26 associated with each of the can combustors 12. Each fuel nozzle 26 in conventional fashion receives air for primary combustion from the pressurized air inlet as illustrated by arrows 28, and may include a primary swirler 30 (FIG. 1) so as to deliver a finely mixed mixture of fuel and air into the primary combustion zone within each of the can combustors 12.

Figure 3:
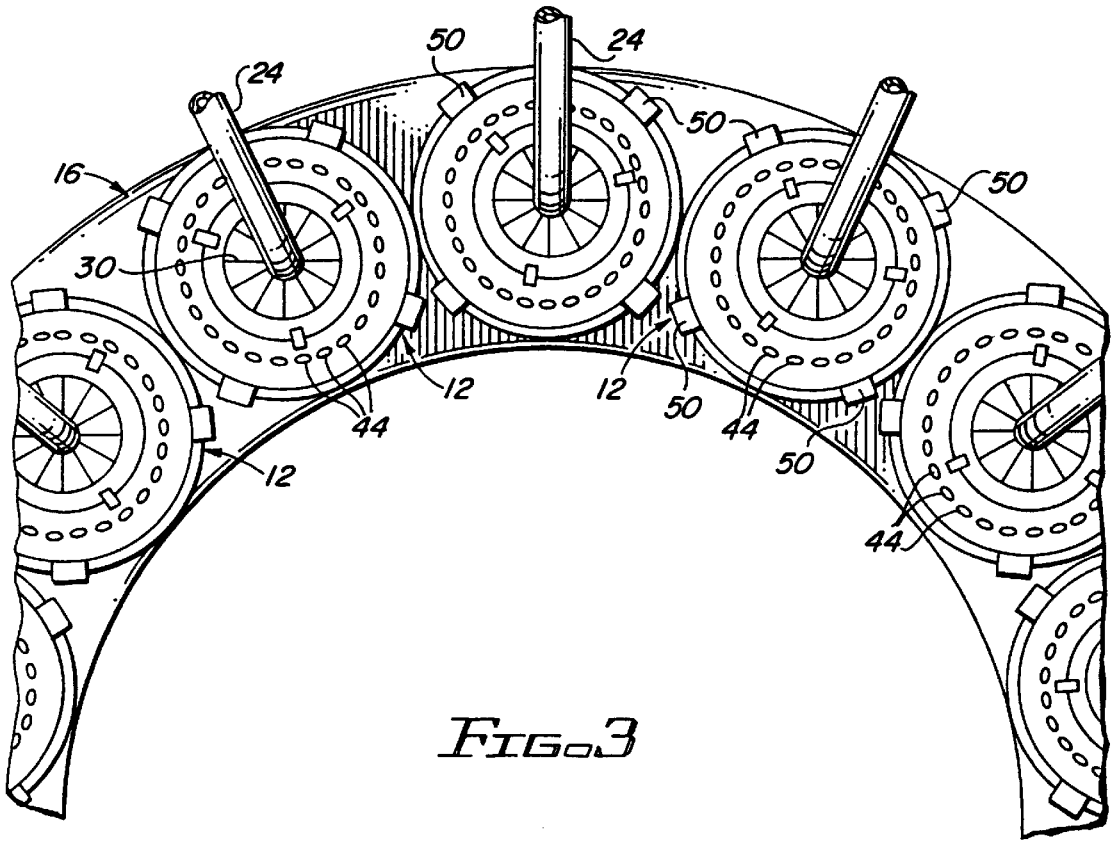
FIG. 3 is a front elevational view of a portion of the combustor of the present invention.

Each can combustor 12 includes a cylindrical outer metal liner 32 and a continuous cylindrical inner ceramic wall 34. For fuel-rich can combustors, the ceramic wall 34 is preferably non-perforated. Preferably the ceramic wall 34 is made of a ceramic matrix composite material. If desired, metal supports 36 may extend radially inwardly from the outer metal wall liner 32 to position the ceramic wall 34 centrally therewithin without inducing thermal stresses on the ceramic wall 34. Defined between outer metal liner 32 and inner ceramic wall 34 is a ring-shaped, annular air space 40 extending axially along the can 12. At the inlet end, the outer metal liner 32 extends radially inwardly to the fuel nozzle 26. A floating metal grommet 42 effectively seals between and intersecures the outer metal liner 12 with the fuel nozzle 26. As best depicted in FIG. 3, the inlet end of the outer liner 32 includes a plurality of inlet air passages 44 disposed in a full circular array for allowing pressurized air from the inlet 20 to enter the annular air space 40 for axial flow therealong on the exterior side of the ceramic wall 34.

Annular metal combustor 16 conventionally includes inner and outer metal walls 44, 46 disposed in an annular configuration normally surrounding the turbine section of the gas turbine engine. As desired, the metal walls 44, 46 may have small openings 48 therein for film or effusion cooling of the metal walls 44, 46.

The inlet end of annular combustor 16 includes a plurality of relatively large openings 49 each of which receives the corresponding exhaust end of the associated can combustor 12. Outer metal liner 32 of each can combustor is rigidly secured to the annular combustor walls 44, 46 such as by a plurality of welded brackets 50. Accordingly, each of the can combustors 12 is rigidly secured to the annular combustor 16 through associated metal liner 32. The annular air passage 40 of each can combustor 12 opens into the inlet of the annular combustor 16, as depicted by arrows 52, to inject pressurized air received from inlet 20 directly in to the annular combustor 16 to support secondary combustion therein as described in greater detail below. In conventional fashion, the outlet end of the annular combustor 16 is appropriately secured to the combustor casing 18 for delivery of hot combustion products through the exhaust 22.

In operation, pressurized air inlet flow from the compressor section of the gas turbine engine is delivered through air inlet 20 inside the annular outer combustor casing 18 in a generally axial direction. Fuel is delivered through each fuel nozzle 26 to mix with air for primary combustion to be delivered in to the interior of each can combustor 12.

Primary combustion occurs inside the ceramic wall 34 of each can combustor 12. Preferably this is a fuel-rich burn combustion process inside each ceramic can combustor 12. If transition to fuel-lean combustion is desired in the can combustors 12, openings along the length of wall 34 may be included instead of the nonperforated configuration shown.

To minimize thermal stress across the ceramic wall 34, its thickness is minimized. Minimization of the thickness of ceramic wall 34 reduces the temperature differential thereacross and therefore minimizes the thermal stresses imposed thereon. Additionally, the annular air passage 40 through which pressurized air flow is delivered provides cooling to the ceramic can 34 and the outer liner 32 to maintain material temperatures of both components within acceptable ranges. It is because of the necessity to minimize the thickness of the ceramic wall 34 that makes it unacceptable for use as a relatively large annular combustor, since the necessary thinness of the wall would subject it to buckling.

The combustion process inside each can combustor 12 continues throughout the axial length thereof and through the openings 49 into the annular combustor 16. That is, the flame front created in the primary combustion zone within each can combustor 12 extends through the associated opening 49 and into the interior of the annular combustor 16.

Significant pressurized air flow is injected into the annular combustor 16 through the annular air passage 40 as depicted by arrows 52 in FIG. 2. The combustion process initiated in each of the can combustors continues within the annular combustor 16 with secondary, fuel-lean combustion occurring therewithin. Because the annular combustor is a continuous, circular configuration, the combustion process therewithin expands circumferentially into a continuous, ring-like combustion front. In this manner, the present invention provides all of the attendant advantages associated with conventional annular combustors, and in particular the elimination of thermal patterning therein. As noted, fuel-lean secondary combustion continues within the annular combustor 16 until the combustion process is completed therewithin. The exhaust products from the combustor 10 are delivered through exhaust 22 to drive the turbine section of the gas turbine engine.

Various alterations and modifications to the foregoing detailed description of a preferred embodiment of the invention will be apparent to those skilled in the art. Accordingly, the foregoing should be considered exemplary in nature and not as limiting to the scope and spirit of the invention as set forth in the appended claims.

Having described the invention with sufficient clarity that those skilled in the art may make and use it, what is claimed is:

1. A gas turbine engine combustor comprising:

an annular casing having a pressurized air inlet, an exhaust, and a fuel supply duct;

a plurality of thin wall, ceramic, can combustors in said casing receiving air from said inlet and fuel from said fuel duct to establish combustion within said can combustors, each of said can combustors including a continuous, non-perforated, cylindrical ceramic wall; and a metallic, annular combustor between said can combustors and said exhaust, said annular combustor receiving air from said inlet and combustion products from said can combustors to continue said combustion within said annular combustor, said can combustors and said annular combustor relatively arranged and configured whereby substantially only fuel-rich combustion occurs in each of said can combustors and substantially only fuel-lean combustion occurs in said annular combustor, and whereby the flame front of said fuel rich combustion in each of said can combustors extends into said annular combustor such that said fuel-lean combustion in said annular combustor is a continuation of said fuel-rich combustion.

2. A combustor as set forth in claim 1, wherein said can combustors are distributed in a circular array about said annular combustor.

3. A combustor as set forth in claim 2, wherein said can combustors are equally spaced about said annular combustor.

4. A combustor as set forth in claim 1, wherein said air and said combustion products flow through said can combustors and said annular combustor primarily parallel to the central axis of said annular combustor.

5. A combustor as set forth in claim 1, wherein each of said can combustors includes an outer, cylindrical, metal liner surrounding said ceramic wall.

6. A combustor as set forth in claim 5, wherein each of said outer metal liners is spaced outwardly from the associated ceramic wall to define an annular air passage extending from said inlet to said annular combustor.

7. A combustor as set forth in claim 6, further including a fuel nozzle at the inlet end of each of said can combustors, and a metallic grommet between each of said nozzles and the associated outer metal liner for sealing therebetween.

8. A combustor as set forth in claim 5, wherein said inlet end of said annular combustor includes openings for receiving each of said can combustors.

9. A combustor as set forth in claim 8, wherein said outer metal liner of each of said can combustors is rigidly secured to said annular combustor.

10. A combustor as set forth in claim 9, further including supports extending across said annular air space to said outer metal liner for supporting said ceramic wall of each of said can combustors while permitting differential thermal expansion between said metal liner and ceramic wall without inducing thermal stresses on said ceramic wall.

11. A combustor as set forth in claim 1, wherein said ceramic walls of said can combustors are comprised of a ceramic matrix composite material.

* * * * *